US006365331B1

(12) United States Patent
House et al.

(10) Patent No.: US 6,365,331 B1
(45) Date of Patent: Apr. 2, 2002

(54) THERMAL FILM HAVING AT LEAST TWO IMAGING LAYERS WITH DIFFERENT PROCESSING CHARACTERISTICS AND A METHOD OF FORMING AND PROCESSING THE SAME

(75) Inventors: Gary L. House, Victor; David H. Levy, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/592,922

(22) Filed: Jun. 13, 2000

(51) Int. Cl.[7] ..... G03C 1/498; G03C 8/40

(52) U.S. Cl. ..... 430/350; 430/15; 430/17; 430/496; 430/503; 430/944

(58) Field of Search ..... 430/15, 17, 496, 430/350, 617, 619, 203, 944, 503

(56) References Cited

U.S. PATENT DOCUMENTS 4,021,240 A 5/1977 Cerquone et al.
4,832,275 A 5/1989 Robertson
4,834,306 A 5/1989 Robertson et al.
5,587,767 A 12/1996 Islam et al.
5,698,365 A 12/1997 Taguchi et al.
6,027,838 A * 2/2000 Rauh et al. ..... 430/22
6,048,110 A 4/2000 Szajewski et al.

* cited by examiner

*Primary Examiner*—Thorl Chea
(74) *Attorney, Agent, or Firm*—David A. Novais

(57) ABSTRACT

A thermal film structure includes at least first and second imaging layers which have different processing characteristics. That is, the first imaging layer is processable at a first temperature while the second imaging layer is processable at a second temperature which is higher than the first temperature. The first and second imaging layers can be coated on or integrated into the film structure. This permits the addition of metadata on the low temperature layer which can be obtained without effecting the development of images on the high temperature layer. Also disclosed is a method for processing the thermal film.

40 Claims, 2 Drawing Sheets

THERMAL FILM HAVING AT LEAST TWO IMAGING LAYERS WITH DIFFERENT PROCESSING CHARACTERISTICS AND A METHOD OF FORMING AND PROCESSING THE SAME

FIELD OF THE INVENTION

The present invention relates to a thermal film structure containing at least two imaging layers with different processing characteristics. More specifically the present invention relates to a thermal film structure having a high temperature imaging layer and a low temperature imaging layer, as well as a method for forming such a film.

BACKGROUND OF THE INVENTION

In the conventional practice of color photography, silver halide film is developed by a chemical technique requiring several steps which include latent image developing, bleaching and fixing. While this technique has been developed over many years and results in exceptional images, the technique requires several chemicals and precise control of times and temperatures of development. Further, the conventional silver halide chemical development technique is not particularly suitable for utilization with compact developing apparatuses. The chemical technique which is a wet processing technique is also not easily performed in the home or small office.

Imaging systems that do not rely on conventional wet processing have received increased attention in recent years. Photothermographic imaging systems have been employed for producing silver images. Typically, these imaging systems have exhibited very low levels of radiation-sensitivity and have been utilized primarily where only low imaging speeds are required. A method and apparatus for developing a heat developing film is disclosed in U.S. Pat. No. 5,537,767. Summaries of photothermographic imaging systems are published Research Disclosure, Volume 170, June 1978, Item 17029, and Volume 299, March 1989, Item 29963. Heat development color photographic materials have been disclosed, for example, in U.S. Pat. No. 4,021,240 and U.S. Pat. No. 5,698,365.

U.S. Pat. No. 6,048,110 discloses an apparatus for thermal development which comprises the use of a thrust cartridge. Also, commercial products such as Color Dry Silver supplied from Minnesota Mining and Manufacturing Company and Pictography™ and Pictrostat™ supplied by Fuji Film Co., Ltd. have been on the market.

It is well known that photothermographic imaging layers can be constructed to process at a wide range of temperatures. For example, current thermal processes which process film in a high temperature range (hereinafter referred to as a HT Process), process films near 150 C for 20 sec, while some commercially available low speed black and white photothermographic films which process film in a low temperature range process the film at 120 C for 5 sec, (hereinafter referred to as a LT Process). The LT Process on a film intended for the HT Process would have no effect. However, the HT Process on a film intended for the LT Process would have the effect of developing the system to a uniform maximum density which would destroy images on the film unless they were somehow stabilized.

SUMMARY OF THE INVENTION

The present invention provides for a thermal film structure having at least two imaging layers with different processing characteristics. The thermal film structure of the present invention would permit the addition of metadata on one layer to enable the reading of such metadata while not effecting images on the other layer.

The present invention therefore provides for a thermal film structure which comprises a film support layer; a first imaging layer provided on one side of the film support layer which can be processed within a first temperature range; and a second imaging layer provided on a second side of the film support layer which can be processed within a second temperature range which is higher than the first temperature range.

The present invention also relates to a thermal film structure which comprises a film support layer; a first imaging layer provided on one side of the film support layer which can be processed within a first temperature range; and a second imaging layer provided on the one side of the film support layer which can be processed within a second temperature range that is higher than the first temperature range.

The present invention also relates to a method of forming a thermal film structure which comprises the steps of: providing a first imaging layer on one side of a film support layer, wherein the first imaging layer is adapted to be processed within a first temperature range; and providing a second imaging layer on a second side of the film support layer, wherein the second imaging layer is adapted to be processed within a second temperature range which is higher than the first temperature range.

The present invention further relates to a method of forming a thermal film structure which comprises the steps of: providing a first imaging layer on one side of a film support layer, wherein the first imaging layer is adapted to be processed within a first temperature range; and providing a second imaging layer on the one side of the film support layer, wherein the second imaging layer is adapted to be processed within a second temperature range which is higher than the first temperature range.

The present invention also relates to a thermal film structure which comprises a film support layer; a first imaging layer provided on one side of the film support layer, with the first imaging layer having first processing characteristics; and a second imaging layer provided on a second side of the film support layer, with the second imaging layer having second processing characteristics which are different from the first processing characteristics.

The present invention also relates to a thermal film structure which comprises a film support layer; a first imaging layer provided on one side of the film support layer, with the first imaging layer having first processing characteristics; and a second imaging layer provided on the one side of the film support layer, with the second imaging layer having second processing characteristics which are different from the first processing characteristics.

The present invention further relates to a method of processing a thermal film which comprises the steps of: providing a film containing a first imaging layer which is processable at a first temperature and a second imaging layer which is processable at a second temperature to a processor; processing the film a first time at the first temperature to develop the first imaging layer while not developing the second imaging layer; scanning the film after the first processing for obtaining information on said first imaging layer; and processing the film a second time at the second temperature to develop images on the second imaging layer while providing a uniform density to the first imaging layer, such that the first imaging layer does not affect a subsequent scanning of the film.

DETAILED DESCRIPTION OF THE INVENTION

Figure 1:
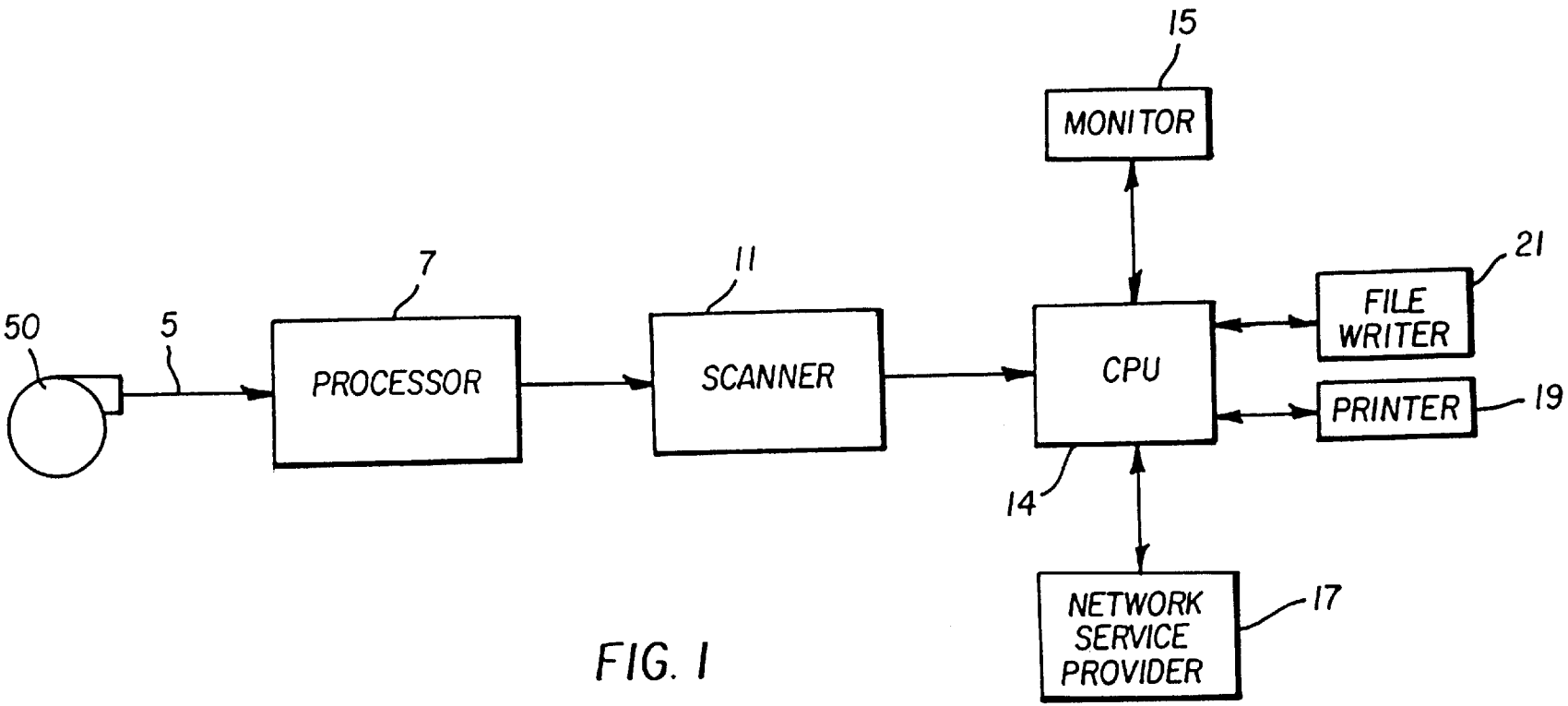
FIG. 1 schematically illustrates an overall thermal processing workflow in accordance with the present invention.

Referring now to the drawings, wherein like reference numerals represent identical or corresponding parts throughout the several views, FIG. 1 illustrates an overall thermal processing workflow. As shown in FIG. 1, a cassette or cartridge 50 having a photosensitive medium, such as an exposed film or thermal film 5 therein, is supplied to a processor 7 for development and processing. Film 5 is preferably located in a thrust cartridge. The thrust cartridge may be any cartridge that allows film to be withdrawn from the cartridge and rewound onto the cartridge multiple times while providing light-tight storage, particularly prior to exposure and development. Typical of such cartridges are those utilized in the advanced photo system (APS) for color negative film. These cartridges are disclosed in U.S. Pat. No. 4,834,306 to Robertson et al and U.S. Pat. No. 4,832,275 to Robertson. U.S. Pat. No. 6,048,110 to Szajewski et al. illustrates a further example of an apparatus for thermal development of thermal film using a thrust cartridge, with the apparatus including a magnetic reader and writer. However, the present invention is not limited thereto, and other methods or types of cassettes for delivering the film to processor 7 can be utilized. Also, processor 7 can be adapted to receive individual film strips and receive and/or extract film from a specially designed one-time use camera.

Processor 7 processes film 5 to develop images on the film. Film 5 is then conveyed to an image scanner 11 to scan and digitize the images generated on the thermally processed film 5. A central processing unit (CPU) 14 digitally process the scanned images so as to provide a suitable digital file. A monitor 15 can be used to view the images and the progress/status of the film processing. After scanning, the digital file can be forwarded to a printer 19 to print the digital files thus rendering a hardcopy output. As a further option, a file output or digital file writer 21 such as a compact disc writer or a floppy disc writer can be enabled to deliver a digital file output. Also, the digital file can be transmitted through, for example, the internet through the use of a network service provider 17. The thermal processing of thermally developable film in accordance with the present invention typically involves the application of heat at processor 7 to the thermal film to develop images on the film. The application of heat can be through the use of, for example, a separate heating element such as a heating plate.

Figure 2:
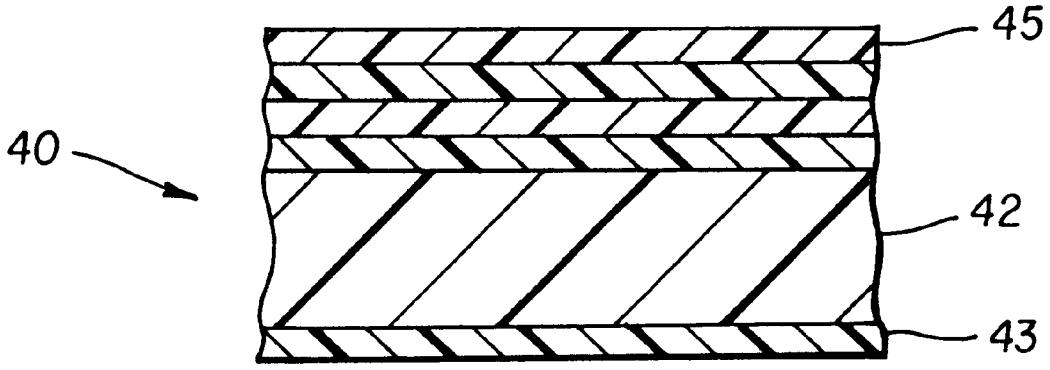
FIG. 2 shows a film structure having imaging layers in accordance with one embodiment of the present invention.

FIG. 2 illustrates a first embodiment of thermal film structure or element in accordance with the present invention. Film structure 40 includes a film support layer 42, a first imaging layer 43 having first processing characteristics, and a second imaging layer 45 having second processing characteristics which are different from the first processing characteristics. In the embodiment of FIG. 2, imaging layers 43 and 45 can be coated onto or integrated into opposite sides of film support layer 45. The first processing characteristics of first imaging layer 43 refer to the fact that imaging layer 43 can be processed at a (LT) low temperature range of approximately 100°–140° C., and preferably at a low temperature of 120° C. (LT process); while the second processing characteristics of second imaging layer 45 refer to the fact that second imaging layer 45 can be processed at a (HT) high temperature range of approximately 140°–200° C., and preferably at a high temperature of 150° C. (HT process).

Therefore, film structure 40 contains two distinct imaging elements, one (HT Process layer) 45 that requires the HT Process and is designed to capture live scenes in a camera, and the other (LT Process layer) 43 that requires the LT Process and is sensitive to radiation to which the high process temperature element is not sensitive. An example would be a HT Process film element (second imaging layer 45) sensitive to red, green, and blue light, combined with a LT Process film element (first imaging layer 43) sensitive to infra-red radiation. As a further example, an LT Process element can be any element that has or forms IR density or density signals that can be scanned outside of the spectral density range of a HT Process element. The film layers or elements 43, 45 may be coated or integrated in any order on any side or sides of film support 42 as desired. As an example first or LT imaging layer 43 could be similar to the formulation for a medical X-Ray output film, such as DryView®. These elements contain very low levels of very fine grain silver halide. As a result, they are slow with effective ISO values less than 1, but they have minimal light scattering properties. The LT element should be sensitive to a spectral region to which the HT process film is not. In the most usual case, the HT process film will be sensitive to red, green, and blue light so the LT film will most conveniently be sensitive to infrared light. The LT layer should be formulated to produce a maximum density of 0.2 to 1.5, preferably 0.3 to 1.2, most preferable to 0.3 to 1.0. The second of HT layers contain large silver halide grains permitting photographic speeds in excess of ISO 1, preferable ISO 10 to ISO 3200, more preferable ISO 25 to ISO 3200.

An example of use of film structure 40 would be to write metadata on the film using an infrared source such as an LED or Laser Diode, which exposes only the LT Process element (first imaging layer 43). This writing can be any combination of information supplied during film manufacturing, camera exposure, processing, or intermediate steps. As an example, LT or first imaging layer 43 could be an encodement layer which is written onto by a specially designed or smart camera. LT Layer 43 could include information that is captured in APS magnetics such as flash-on-off, illuminant etc. Also, information such as sound or text can be provided on each frame of LT Layer 43. Further, instructions (metadata) for subsequent processing and/or digital photofinishing can be provided on LT Layer 43.

During processing, the film would first be subjected to a process temperature at processor 7 that develops the LT Process layer 43 without affecting the HT Process layer 45. The information from the LT layer 43 could then be extracted with infra-red scanning at scanner 11 and used for any purpose desired. The film can then be returned to processor 7 or forwarded to a second processor (not shown) for processing at the high process temperature. This will have the effect of causing image related information from the HT Process layer 45 to become available, as well as rendering the LT Process layer 43 to a uniform density that will not interfere with scanning of the HT Process layer 45 at scanner 11.

Figure 3:
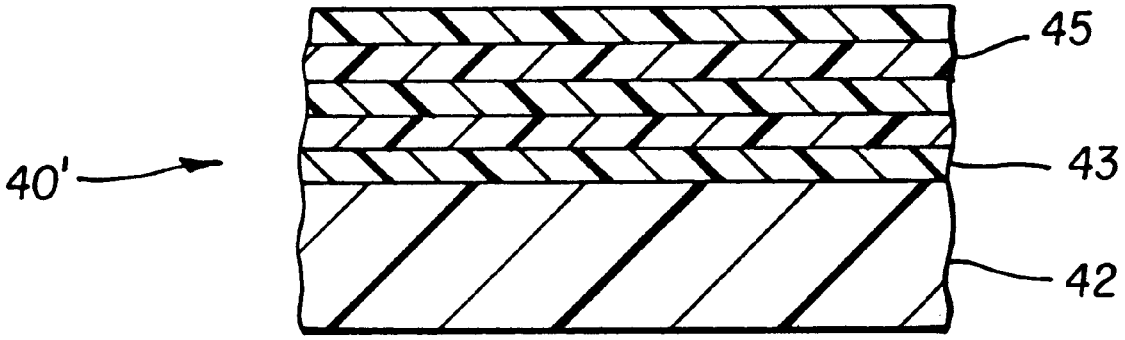
FIG. 3 shows a film structure having imaging layers in accordance with a second embodiment of the present invention.

In a second embodiment of the invention as illustrated in FIG. 3, it is noted that the invention is not limited to placing the imaging layers on opposite sides of film support 42. For example as shown in FIG. 3, film structure 40' can include an LT process layer 43 coated on or integrated into one side of film support 42, and an HT process layer 45 coated on or integrated into LT process layer 43. As a further option, HT process layer 45 can be coated on or integrated into film support 42, while LT process layer 43 can be coated on or integrated into HT process layer 45.

Therefore, the present invention provides for a film structure that includes a low temperature processable layer that can contain metadata and a high temperature processable layer that can include image information.

The invention has been described in detail with particular reference to certain preferred embodiments thereof, but it will be understood that variations and modifications can be effected within the spirit and scope of the invention.

What is claimed is:

1. A thermal film structure comprising:

a film support layer;

a first imaging layer provided on one side of said film support layer which can be processed within a first temperature range; and a second imaging layer provided on a second side of said film support layer which can be processed within a second temperature range which is higher than said first temperature range.

2. A thermal film structure according to claim 1, wherein said first temperature range is approximately 100° to 140° C.

3. A thermal film structure according to claim 1, wherein said second temperature range is approximately 140° to 200° C.

4. A thermal film structure according to claim 1, wherein said first imaging layer comprises a low speed black and white imaging element which is sensitive to infra-red radiation.

5. A thermal film structure according to claim 1, wherein said first imaging layer can be scanned outside of a spectral density range of said second imaging layer.

6. A thermal film structure according to claim 1, wherein said second imaging layer comprises a color film element which is sensitive to red, green and blue light.

7. A thermal film structure according to claim 1, wherein each of said first and second imaging layers are coated on said film support layer.

8. A thermal film structure according to claim 1, wherein each of said first and second imaging layers are integrated into said film support layer.

9. A thermal film structure comprising:

a film support layer;

a first imaging layer provided on one side of said film support layer which can be processed within a first temperature range; and a second imaging layer provided on said one side of said film support layer which can be processed within a second temperature range which is higher than said first temperature range.

10. A thermal film structure according to claim 9, wherein said first temperature range is approximately 100° to 140° C.

11. A thermal film structure according to claim 9, wherein said second temperature range is approximately 140°–200° C.

12. A thermal film structure according to claim 9, wherein said first imaging layer comprises a low speed black and white imaging element which is sensitive to infra-red radiation.

13. A thermal film structure according to claim 9, wherein said first imaging layer can be scanned outside of a spectral density range of said second imaging layer.

14. A thermal film structure according to claim 9, wherein said second imaging layer comprises a color film element which is sensitive to red, green and blue light.

15. A thermal film structure according to claim 9, wherein said first imaging layer is coated on the one side of said support layer and said second imaging layer is coated on said first imaging layer.

16. A thermal film structure according to claim 9, wherein said first imaging layer is integrated into the one side of said support layer and said second imaging layer is integrated into said first imaging layer.

17. A thermal film structure according to claim 9, wherein said second imaging layer is coated on the one side of said support layer and said first imaging layer is coated on said second imaging layer.

18. A thermal film structure according to claim 9, wherein said second imaging layer is integrated into the one side of said support layer and said first imaging layer is integrated into said second imaging layer.

19. A method of forming a thermal film structure, the method comprising the steps of:

providing a first imaging layer on one side of a film support layer, wherein said first imaging layer is adapted to be processed within a first temperature range; and providing a second imaging layer on a second side of said film support layer, wherein said second imaging layer is adapted to be processed within a second temperature range which is higher than said first temperature range.

20. A method according to claim 19, wherein said first temperature range is approximately 100° to 140° C.

21. A method according to claim 19, wherein said second temperature range is approximately 140° to 200° C.

22. A method according to claim 19, wherein said first imaging layer comprises a low speed black and white imaging element which is sensitive to infra-red radiation.

23. A method according to claim 19, wherein said first imaging layer can be scanned outside of a spectral density range of said second imaging layer.

24. A method according to claim 19, wherein said second imaging layer comprises a color film element which is sensitive to red, green and blue light.

25. A method according to claim 19, wherein said steps of providing said first and second imaging layers on said film support layer comprises coating each of said first and second imaging layers on said film support layer.

26. A method according to claim 19, wherein steps of providing said first and second imaging layers on said film support layer comprises integrating each of said first and second imaging layers on said film support layer.

27. A method of forming a thermal film structure, the method comprising the steps of:

providing a first imaging layer on one side of a film support layer, wherein said first imaging layer is adapted to be processed within a first temperature range; and providing a second imaging layer on said one side of said film support layer, wherein said second imaging layer is adapted to be processed within a second temperature range which is higher than said first temperature range.

28. A method according to claim 27, wherein said first temperature range is approximately 100° to 140° C.

29. A method according to claim 27, wherein said second temperature range is approximately 140° to 200° C.

30. A method according to claim 27, wherein said first imaging layer comprises a low speed black and white imaging element which is sensitive to infra-red radiation.

31. A method according to claim 27, wherein said first imaging layer can be scanned outside of a spectral density range of said second imaging layer.

32. A method according to claim 27, wherein said second imaging layer comprises a color film element which is sensitive to red, green and blue light.

33. A method according to claim 27, wherein said steps of providing said first and second imaging layers on said one side of said film support layer comprises coating said first imaging layer on the one side of said support layer, and coating said second imaging layer on said first imaging layer.

34. A method according to claim 27, wherein said steps of providing said first and second imaging layers on the one side of said film support layer comprises integrating said first imaging layer into the one side of said support layer, and integrating said second imaging layer into said first imaging layer.

35. A method according to claim 27, wherein said steps of providing each of said first and second imaging layers on the one side of the film support layer comprises coating said second imaging layer on the one side of said support layer, and coating said first imaging layer on said second imaging layer.

36. A method according to claim 27, wherein said steps of providing each of said first and second imaging layers on the one side of the film support layer comprises integrating said second imaging layer into the one side of said support layer, and integrating said first imaging layer into said second imaging layer.

37. A thermal film structure comprising:

a film support layer;

a first imaging layer provided on one side of said film support layer, said first imaging layer having first processing characteristics; and a second imaging layer provided on said one side of said film support layer, said second imaging layer having second processing characteristics which are different from said first processing characteristics.

38. A thermal film structure according to claim 37, wherein said first processing characteristics permit a processing of the first imaging layer at a first temperature, and the second processing characteristics permit a processing of the second imaging layer at a second temperature which is higher than the first temperature.

39. A method of processing a thermal film comprising the steps of:

providing a film containing a first imaging layer which is processable at a first temperature and a second imaging layer which is processable at a second temperature to a processor;

processing the film a first time at the first temperature to develop the first imaging layer while not developing the second imaging layer;

scanning the film after the first processing for obtaining information on said first imaging layer; and processing the film a second time at the second temperature to develop images on the second imaging layer while providing a uniform density to the first imaging layer, such that the first imaging layer does not affect a subsequent scanning of the film.

40. A method according to claim 39, comprising the further step of:

scanning the film after the second processing to create a digital file of the images on the second imaging layer.

* * * * *